United States Patent [19]

Achelpohl

[11] Patent Number: 4,547,111

[45] Date of Patent: Oct. 15, 1985

[54] APPARATUS FOR STACKING FLAT ARTICLES

[75] Inventor: Fritz Achelpohl, Lengerich, Fed. Rep. of Germany

[73] Assignee: Windmoller & Holscher, Lengerich, Fed. Rep. of Germany

[21] Appl. No.: 500,352

[22] Filed: Jun. 2, 1983

[30] Foreign Application Priority Data

Jun. 4, 1982 [DE] Fed. Rep. of Germany ..... 3221243

[51] Int. Cl.[4] ..... B65G 17/16

[52] U.S. Cl. ..... 414/27; 198/692; 198/802

[58] Field of Search ..... 414/27; 198/692, 693, 198/802

[56] References Cited

U.S. PATENT DOCUMENTS

| | | | |
|---|---|---|---|
| 3,303,921 | 2/1967 | Gore | 198/802 |
| 3,431,828 | 3/1969 | Crawford et al. | 198/693 X |
| 3,555,977 | 1/1971 | Saumsiegle | 414/27 X |
| 4,095,392 | 6/1978 | van de Gent | 414/27 X |
| 4,231,558 | 11/1980 | Atelianus et al. | 270/60 |
| 4,252,233 | 2/1981 | Joice | 198/692 |
| 4,286,907 | 9/1981 | Houle et al. | 414/27 X |

FOREIGN PATENT DOCUMENTS

| | | |
|---|---|---|
| 885414 | 3/1981 | Belgium . |
| 2254158 | 11/1972 | Fed. Rep. of Germany . |
| 8000912 | 4/1980 | Fed. Rep. of Germany . |
| 3138221 | 6/1982 | Fed. Rep. of Germany . |

*Primary Examiner*—Robert J. Spar
*Assistant Examiner*—Janice Krizek
*Attorney, Agent, or Firm*—Fleit, Jacobson, Cohn et al.

[57] ABSTRACT

In apparatus for stacking flat articles such as flattened bags, two spaced rotatable hubs carry radial transfer arms provided with suction nozzles. By perforations on one side of the articles, the latter are collected up to the desired stacking height on prongs provided at one side of endless conveying members of an intermittently operative conveyor. The other sides of the articles hang over the other side of the conveying members where the latter are provided with supporting frames or plates which project laterally beyond the conveyor and are mounted at their central region on two parallel pivot shafts which are secured to the coveying members, extend transversely thereto and are spaced apart sufficiently to enable them to pass over direction-changing drums or wheels of the conveying members.

4 Claims, 3 Drawing Figures

Fig. 3
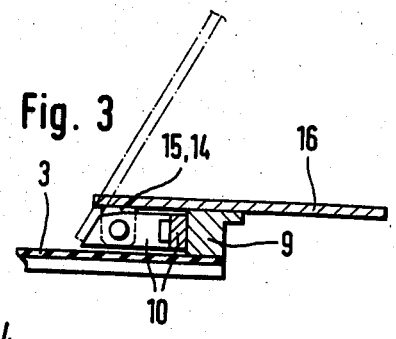
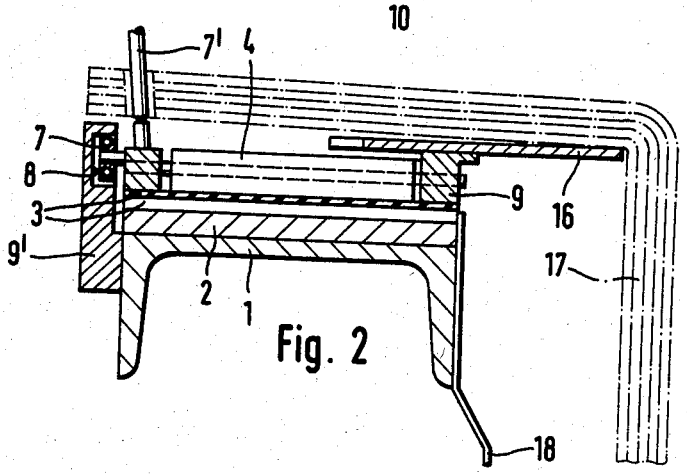
Fig. 2
Fig. 1
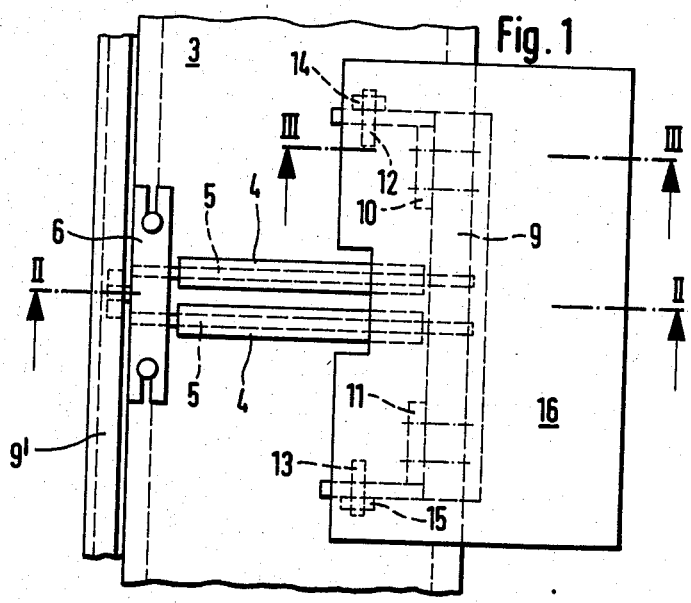

APPARATUS FOR STACKING FLAT ARTICLES

The invention relates to apparatus for stacking flat articles such as tube sections, bags or the like, comprising two spaced hubs which rotate synchronously about a horizontal axis and carry radial arms arranged in star formation at equal angular spacings, the leading sides of the arms being equipped with suction nozzles, depositing or supporting means for the arriving articles which are disposed between the arms in the region of the horizontal plane containing the axis, the articles projecting laterally beyond the said means so that their side edges at least partially intersect the planes of rotation of the arms, and intermittently operative conveying means with circulating endless pull members which on one side carry vertical prongs, pairs of pins or the like and have their receiving side so disposed between the planes of rotation of the arms that the articles inverted by the arms are collected on the prongs or the like up to the desired stacking height by recesses or perforations on one side of the articles and the opposite sides hang over the other side of the conveying means.

In known apparatuses of this kind, the ends of the stacks hang laterally over the conveying means and scrape along side portions thereof during the intermittent transport, so that the individual bags can slip or become displaced in the stack, whereby packaging of the stacks of bags in cartons adapted particularly to the stack height can be made considerably more difficult.

In an apparatus of the aforementioned kind known from DE-GMS 80 00 912, a bar over which the lower ends of the stack hang is provided parallel to the upper run of the pull members of the conveyor at the side opposite to the stacking prongs. Although such bars can be provided with friction-reducing coverings, displacement of the bags in the stacks is not impossible as the stacks are pulled over the bars.

It is therefore an object of the invention to provide an apparatus of the aforementioned kind in which the stacks cannot slip as they are intermittently conveyed away from the suction arm wheels.

According to the invention, this problem is solved in that the pull members consisting of chains, bands or belts are provided on the side opposite to the prongs or the like with supporting frames or plates which project laterally beyond the conveying means and are mounted at their central region on two parallel pivot shafts which are secured to the pull members, extend transversely thereto and are spaced apart only sufficiently to enable them to pass over direction-changing drums or wheels of the pull members. In the apparatus of the invention, therefore, each of the prongs or pairs of pins is associated with special supporting means over which the ends of the stacks hang in such a way that they no longer make contact with side portions of the conveying means.

For safety reasons, the conveying means are usually provided with lateral coverings or protective plates which could obstruct the return movement of the supporting frames or plates along the lower run of the pull members. For this reason, in one embodiment of the invention carriers are provided on the pairs of pivot shafts spaced in the conveying direction from the stacks to be formed, the supporting frames or plates being pivoted at their inner margins to the carriers about pivot pins parallel to the latter.

Near the rear direction-changing drum or wheels, means may be provided for swinging the supporting frames or plates up towards the prongs and thereby preventing their collision with the protecting plates. While passing along the lower run, the supporting frames or plates hang down under gravity so that they cannot touch the lateral supporting plates. The cantilever length and the pivot angle of the supporting frames or plates are such that, in the inwardly swung condition, they lie within the projection of the pull members.

To avoid outward tilting of the pull members over the supporting frames or plates projecting beyond the conveying means, the chain or belt side opposite to the supporting frames or plates may carry guide rollers which project beyond the pull members and are guided in a guide rail extending parallel to the upper run of the chain or belt.

The pivot shafts may be held in parallel beads of one band or toothed belt.

Desirably, the pivot shafts project beyond their carriers or beads at both sides and a carrier carrying the prongs at the ends is centrally mounted on the stub axles opposite to the supporting frames or plates.

One example of the invention will now be described in more detail with reference to the drawing, wherein:

FIG. 1 is a fragmentary plan view of the conveying means in the region of a supporting plate;

FIG. 2 is a section through the upper run of the conveying means on the line II—II in FIG. 1, and FIG. 3 is a section through the supporting plate in the region where the latter is pivotally mounted.

The conveying means are carried by a U section 1 which is fixed with respect to the frame and to which a slide plate 2 is secured. Toothed discs (not shown) provided in front of and behind this section 1 are enveloped by a toothed belt 3. With its teeth on the underside of the upper run, the toothed belt 3 lies on the fixed slide plate 2. Transversely extending mountings 4 receiving rods 5 are vulcanized in pairs at fixed spacings onto the outwardly directed side of the toothed belt 3. Both ends of the rods 5 project from the mountings 4. The ends of the rods projecting from the pairs 4 of holders at the left of the drawing carry a bridge 6 which, as is shown in FIG. 2, carries bag locating means in the form of two upstanding prongs 7'. The bridge 6 also has a pin which carries a ball bearing 7 running in a guide 8. This guide 8 is milled into an arm 9' fixed to the stationary section 1. The ends of the rods projecting from the mountings 4 at the right of FIG. 1 likewise carry a bridge 9 which lies loosely on the toothed belt 3. Two holders 10 and 11 connected to the ends of this bridge 9 have angled arms which each contain a bore. Pins 12 and 13 passing through these bores are secured in consols 14 and 15. The latter carry a flap 16 which is pivotable about the pins 12 and 13 and rests on the bridge 9. As is shown in FIG. 2, the dimensions of the flap 16 are such that the depending bags of the stack 17 cannot scrape along the lateral covering 18 during movement of the toothed belt 3. At the locations where the toothed belt 3 changes direction, these flaps 16 are swung by cam rails (not shown) into the broken line position shown in FIG. 3 so that the flaps will not make contact with the lateral cover 18 in the region of the lower run. This lateral cover 18 is on the side of the operator and serves for his protection.

I claim:

1. Intermittently operating stacking and carrying apparatus for bags that have been supplied by a bag machine and collected into stacks, said apparatus comprising:

an endless conveying means that circulates over guide wheels;

locating means on the conveying means for receiving and positioning a plurality of bags, the locating means cooperable with holes punched out of the bags and for mounting and supporting a stack of bags;

plate support means carried on said conveying means and spaced from and opposite said locating means;

supporting plates carried on the plate support means, the supporting plates pivotable about an axis extending in the direction of movement of the conveying means and positioned inwardly of the edge of the conveying means, the supporting plates extending partially over the conveying means and projecting laterally beyond an edge thereof; and interconnecting means extending across the conveying means for directly interconnecting the locating means with the plate support means, the interconnecting means including pivot shafts having their axes extending transversely to the direction of movement of the conveying means and spaced longitudinally from each other at a distance sufficient to permit them to pass over the guide wheels of the conveying means.

2. Stacking apparatus in accordance with claim 1 wherein the supporting plate pivot axis in parallel to the direction of movement of the conveying means and adjacent an inner marginal edge of the support plate.

3. Stacking apparatus in accordance with claim 1 wherein the supporting plates are pivotable inwardly of the conveying means about the pivot axis and toward the locating means.

4. Stacking apparatus in accordance with claim 3 wherein the supporting plates are pivotable inwardly of the conveying means to a point that the plates lie within a perpendicular projection of the conveying means when the plates are in their innermost position.

* * * * *